United States Patent [19]

Bogdan et al.

[11] Patent Number: 4,659,445

[45] Date of Patent: Apr. 21, 1987

[54] PROCESS FOR COATING HOLLOW BODIES, WHICH ARE OPEN ON ONE END

[75] Inventors: Wolfgang Bogdan; Hans-Peter Patzschke, both of Wuppertal; Hans-Jürgen Schlinsog, Cremlingen, all of Fed. Rep. of Germany

[73] Assignee: Herberts Gesellschaft mit Beschrankter Haftung, Wuppertal, Fed. Rep. of Germany

[21] Appl. No.: 575,454

[22] Filed: Jan. 31, 1984

[30] Foreign Application Priority Data

Feb. 12, 1983 [DE] Fed. Rep. of Germany ..... 3304940

[51] Int. Cl.[4] ..... C25D 13/00

[52] U.S. Cl. ..... 204/181.1; 204/299 R; 204/299 EC; 204/300 EC; 427/230; 427/231; 427/232; 427/235

[58] Field of Search ..... 204/181 R, 299 R, 300 EC, 204/299 EC; 427/230, 231, 232, 235

[56] References Cited

U.S. PATENT DOCUMENTS

| | | | |
|---|---|---|---|
| 3,253,943 | 5/1966 | Mayer et al. | 427/235 |
| 3,694,336 | 9/1972 | Fiala | 204/300 EC |
| 3,801,485 | 4/1974 | Kossmann | 204/181 R |
| 4,107,016 | 8/1978 | Brower, Jr. et al. | 204/181 R |
| 4,158,619 | 6/1979 | Brower, Jr. et al. | 204/181 R |
| 4,400,251 | 8/1983 | Heffner et al. | 204/181 R |

FOREIGN PATENT DOCUMENTS

| | | | |
|---|---|---|---|
| 1395383 | 5/1975 | United Kingdom | 204/300 EC |

*Primary Examiner*—R. L. Andrews

*Attorney, Agent, or Firm*—Mandeville and Schweitzer

[57] ABSTRACT

In order to coat hollow bodies, which are open at one end, such as a metal can provided with a bottom, with a lacquer or the like, the hollow bodies are passed in a continuous operating cycle through en electrophoretic immersion bath in such a way, that they are rapidly and completely flooded with immersion bath liquid, so that they can be coated electrophoretically with a wet film in the immersion bath. After a sufficiently long coating time, the hollow bodies are lifted out of the immersion bath and the immersion bath liquid, contained in them, is poured out. The hollow bodies, so coated, are carried at a distance from each other to a drying kiln, in which they are dried, whereupon they can be printed or labelled.

21 Claims, 3 Drawing Figures

PROCESS FOR COATING HOLLOW BODIES, WHICH ARE OPEN ON ONE END

BACKGROUND OF THE INVENTION

The invention relates to a process for coating hollow bodies, which are open at one end, such as metal cans provided with a bottom, with lacquer or the like, in which the individual hollow bodies are washed, coated on the inside and on the outside and dried and then optionally printed and dried once again and moreover flanged at the open end.

The increasingly tightened requirements of environmental protection lead to considerations of how processes, such as the electrophoretic lacquering process, which is also referred to as electrocoating (EC), can be introduced as a fully automatic lacquering process in the can manufacturing industry. The processes of lacquering the sides of the three-part cans or of coating a weld electrophoretically by immersion in an electrophoretic immersion bath are well known (U.S. Pat. No. 3,694,336, German Offenlegungsschrift No. 2,116,715). The can bodies are easily handled here, because they do not yet have a bottom and the bath liquid can enter without difficulties for the coating process and can leave once again equally well without difficulties after the coating process.

Hollow bodies, which are closed on one side, such as cans provided with a bottom, cannot easily be coated electrophoretically, because it is necessary that the air in the hollow body escapes completely so that a uniform coating will be produced. The engineering industry therefore developed special methods, in which the process is carried out in steps, that is, lacquering is carried out in individual, consecutive steps, for example, on the inside to start with. The contructions, known for this purpose, have some common features. For instance, the cans are held at the bottom for lacquering the inside and the necessary electrical contacts are produced at the same time. A counterelectrode is installed in the open end of the can and must be at a small distance of 0.25 to 5 mm from the inside wall of the can. The shape of the electrode therefore has to be adjusted very accurately to that of the can. Because of the complicated construction of the appropriate equipment, the cans must be coated individually and consecutively, so that only short coating times of 10 to 500 msec are available, if a high throughput of cans is to be achieved. In closed systems with, for example, a vertical arrangement (European Pat. Nos. 50,045 and 19,669, British Patent No. 1,117,831, U.S. Pat. No. 3,922,213 and German Offenlegungsschrift No. 2,929,570), the liquid must be pumped at high speeds in order to be able to carry out (coating with) the EC liquid and rinsing with water alternately in short time spans and to remove the gases formed during the EC coating process (oxygen or hydrogen, depending on the polarity). In open systems, the cans, which are arranged approximately horizontally, must be turned in order to achieve a uniform coating (German Patent No. 2,633,179 and U.S. Pat. No. 4,107,016). There is great danger of contamination when blowing out the cans.

The disadvantage of all of these known constructions lies therein that the cans must be coated individually and consecutively with great mechanical effort. The large space required for the equipment makes economic mass production almost impossible. The internal electrodes can be inserted so as to fit accurately only in cans with smooth, straight walls; that is, can shapes, which deviate from the cylindrical, cause great difficulties. Because of the small distances between the internal electrode and the can wall, there is a risk of short circuits as well of disruptive electrical discharges in zones of very high current density. Lacquers must therefore be used, which make trouble-free coating processes possible at suitable voltages in the short times available.

SUMMARY OF THE INVENTION

It is an object of the invention to simplify the coating process of hollow bodies, open at only one end, such as cans provided with a bottom, in such a way that these bodies can be coated on the outside as well as on the inside in one continuous operating cycle.

This objective is accomplished inventively in a process of the class mentioned at the beginning, wherein each hollow body in a continuous operating cycle with its opening pointing slightly diagonally downwards is dipped into an electrophoretic immersion bath, moved while submerged in the bath in such a way that its opening points upwards, and subsequently, with its opening pointing slightly downwards, lifted out of the bath and then passed through one or several drying kilns with an endless means of transportation. Advantageous configuration of the invention are the object of the subclaims. Through the invention, it is possible to coat hollow bodies, which are open at one end, such as metal cans provided with a bottom, simultaneously on the outside and on the inside in one operating cycle and to dry them immediately afterwards and, if necessary, to print or label them. The mechanical effort involved and the space required are relatively small, so that an economic method of operation is possible. For example, 16 cans can be passed simultaneously, that is, next to each other, through an electrophoretic immersion bath and, in so doing, coated with lacquer. As they pass through the immersion bath, the cans are tilted by at least 90° by the transporting element holding them, so that they dip into the bath initially with their longitudinal axis inclined with their openings slightly downward and are then tilted in the bath so that their longitudinal axis points diagonally in the opposite direction, so that the opening now points upwards. For lifting them out of the immersion bath, the cans are tilted once again, so that the opening now is at the bottom and the liquid in the cans can drain completely. The tilting can take place in the bath, while the cans are being lifted out of the bath or shortly thereafter.

The transporting element can be an endless conveyor belt or also an endless chain, from which the cans hang so that they can be rotated and which is passed through the EC immersion bath. Also suitable are wheels or rollers, which continuously guide the hollow bodies, which are to be coated, through an aqueous immersion bath.

Since the hollow body is passed through an immersion bath for the coating process and, in so doing, it is also possible to pass several hollow bodies simultaneously and next to each other through the immersion bath, coating times, sufficiently long to apply perfect lacquer coatings, can be achieved even in mass production with a high throughput. For example, when a pigmented or unpigmented lacquer is applied electrophoretically by means of direct current, the wet film, deposited on the hollow body, has a film resistance of at least $0.6\times10^8$ ohms$\times$cm.

The hollow bodies to be coated are connected as anode by a holding device when an anionic EC lacquer is used and as cathode when a cationic EC lacquer is used. The counterelectrode is in each case at the required distance from the hollow body in the immersion bath and/or in the can. Depending on the embodiment, the coating process on the inside and on the outside is accomplished with or without the help of an auxiliary electrode with the help of the so-called throwing power, which the lacquer achieves, because its insulating effect in the deposited wet film is as high as possible. Before the coating process on the inside is started, all the air in the hollow body must escape from the interior.

DETAILED DESCRIPTION OF THE INVENTION

A series of factors must be taken into consideration in the development of the lacquer in order to achieve as high a throwing power as possible. The electrophoretic coating process takes place in such a way, that the wall opposite to the counterelectrode, e.g. the outside wall of the hollow body, is coated first. Due to the build-up of wet film, the outer wall is the first to become insulated. The lines of electric flux then migrate to the interior of the hollow body, where deposition continues. The deposition time and the insulating effect of the material, characterized by the film resistance and the ready coagulatability, must be matched to each other in order to achieved a good throwing power. The lower limit of the coating time should lie above 3 seconds, especially above 5 seconds and preferably above 10 seconds. The upper limit is determined by the length of the immersion bath, by the transporting velocity and by the number of hollow bodies to be coated. In order to arrive at an economically justifiable rate, the upper limit for the coating time should advisably be below 60 seconds and preferably below 30 seconds. The amount of film applied depends on the deposition voltage, which lies between 50 and 400 volts and preferably between 100 and 300 volts. With increasing voltage, an improvement in throwing power is achieved. In order to avoid disruptive electrical discharges, either the voltage is continuously adjusted high or a low bias and several, stepwise increasing biases are used. For example, before the actual coating process, voltages below 100 volts are used for 0.1 to 0.5 seconds.

The wet-film resistance, required for good insulation, should in principle be as high as possible. Its lower limit is however determined by the desired short coating time. Accordingly therefore, the lower limit should be at least $0.8\times10^8$ ohms×cm, advisably greater than $1.0\times10^8$ and preferably greater than $2\times10^8$ ohms×cm. The higher the film resistance, the thinner is the coating, which can be attained on the wall of the can. The upper limit therefore lies below $10\times10^8$ ohms×cm, advisably below $7\times10^8$ ohms×cm and preferably below $4\times10^8$ ohms×cm. In order to make electrical current available, in an amount required required for electrophoretic deposition analogously to Faraday's laws, the bath conductivity, which is determined by the degree of neutralization of the binder, should be higher than 600 μmho/cm, advisably higher than 800 μmho/cm and preferably higher than 1,200 μmho/cm.

As binders, anionic as well as cationic resins can be used, the anionic resins being preferred for acidic and the cationic resins for basic can contents. The anionic resins, such as maleinated or acrylated butadiene oils, maleinated natural oils, carboxyl-group-containing epoxide resin esters and acrylate resins, acrylepoxide resins, unmodified polyesters or polyesters modified with fatty acids, have an acid number of 30 to 180, and especially an acid number between 40 and 80, and are neutralized at least partially with ammonia, amines or aminoalcohols. Readily volatile amines are preferred, so that they can be removed from the film as completely as possible during the short stoving times of 10 to 30 seconds. Ammonia is especially preferred.

Cross linking takes place oxidatively over unsaturated double bonds or through thermal reaction with appropriate cross linking agents, such as phenolic resins, amine-formaldehyde resins or blocked polyisocyanates. Externally cross linked or self cross linked acrylate resins are preferred for producing white enamel coatings. Externally or self cross linked acrylate resins, acrylated or maleinated epoxide esters or epoxyacrylates are preferred for coating processes with clear lacquers.

The cationic resins, such as butadiene oil/aminoalkylimides, Mannich bases of phenolic resins, amino-group-containing acrylate resins or aminoepoxide resins have an amine number of 30 to 120 mg KOH/g of solid resin, and preferably of 50 to 90, and are at least partially neutralized with organic monocarboxylic acids, such as carbonic acid, formic acid, acetic acid, lactic acid, etc. Apart from unsaturated double bonds, preferably blocked polyisocyanates or resins, which contain transesterifiable ester groups, are used as cross linking agents.

The binders are partially neutralized with the neutralizing agents and, if ncessary, diluted with deionized or distilled water. Primary, secondary and/or tertiary alcohols, ethylene or propylene glycol mono- or diethers, diacetone alcohol or also small portions of solvents, which cannot be diluted with water, such as naphtha hydrocarbons, are suitable as solvents.

The solvent content aimed for is as low as possible, advisably below 15 weight percent and preferably below 5 weight percent, since the throwing power deteriorates with increasing solvent content.

The solids content of the bath generally lies between 5 and 30 weight percent and especially above 8 and below 20 weight percent. As the solids content rises, the conductivity of the bath increases and the deposition equivalent (amps×sec/g) decreases, as a result of which the throwing power can be increased. Due to the high concentration of film-forming ions, the film resistance at the same time passes through a maximum.

The bath temperature lies between 20° and 35° C. The throwing power increases with decreasing temperature. Temperatures below 20° C. are uneconomic, because the heat, developed by the EC coating process, must be carried away by much cooling water. Temperatures above 35° C. make it more difficult to control the bath, because too much solvent evaporates and hydrolysis phenomena in the binder system cause fluctuations in the electrical data.

The coating agents may additionally contain conventional lacquering auxiliaries, such as catalysts, levelling agents, antifoamers, lubricants, etc. Naturally, additives should be selected, which do not enter into any interfering reactions with water at the pH of the bath, introduce no interfering foreign ions and do not precipitate on prolonged standing in a form in which they cannot be redispersed.

Pigmented or unpigmented binders can be used. Materials can be employed as pigments and fillers which, on the basis of their small particle size of less than 10 μm and especially of less than 5 μm, can be stably dispersed in the lacquer and redispersed after standing. They may not contain any interfering foreign ions, nor may they react chemically with water or the neutralizing agent.

The pigmentation can be white or also colored. White is preferred. When interference pigments are additionally incorporated, it is possible to achieve metal-effect lacquerings with aluminum, silver, brass, copper and gold effects, etc. Pigments, such as titanium dioxide, are ground in concentrated form and then adjusted with further binder to a pigment-binder ratio of from about 0.1 to 1 to 0.7 to 1. The throwing power is increased by the incorporation of pigments. Instead of pigments, it is also possible to use finely pulverized nonionic resins, such as pulverized polyhydrocarbon resins, epoxide resins and/or blocked polyisocyanates, the amounts added being selected so that they do not exceed the maximum of the film resistance. Binders, pigment content, bath solids, solids content, selection of neutralizing agent and the degree of neutrality are so matched to the coating conditions such as bath temperature and deposition voltage and time, that there is complete coating in the electrophoresis immersion bath. After stoving, the coating in the interior of the can is pore-free and at least 3 μm, preferably at least 4 μm and especially at least 5 μm and at most 10 μm and especially at most 7 μm thick.

The EC lacquering process is carried out in an immersion bath. The hollow bodies, which are closed at one end (e.g. cans), can be guided at their opening with the help of a magnetic, electromagnetic or mechanical holding device, which is also understood to include holding by vacuum. The turning of the can in the filled electrophoresis lacquering basin and the position of the can during the electrophoretic coating process ensure that the gases formed can escape upwards. Due to the speed of transport and the rotatable mounting, a current is produced in the can, which carries away the heat formed by the electrophoresis. The simple construction of the suspension gear enables the cans to be at a short distance from one another. The can is emptied again by a rotation, in which the bottom of the can is guided upwards. Direct current is used as the source of current. The hollow body is connected through the holding device as an anode or as a cathode, depending on the type of binder. The counterelectrode is located, for example, outside of the hollow body in the electrophoretic immersion bath. Because of the throwing power of the lacquer and the deposition voltage and coating time required for the particular shape of the can, the can is coated completely on the inside and on the outside. This process has the advantage that the complete coating process or the residual coating process on the outside and the inside takes place in a single step of the process and that, due to the slight mechanical effort, many cans can be coated simultaneously and next to each other on the suspension gear.

For support, especially when high rates of passage through the equipment are desired, an auxiliary electrode can additionally be introduced into the can. The shape of the immersion electrode is not determined by the can and the diameter of the electrode is less than half the diameter of the can. The immersion electrode preferably is arranged, so that it is introduced into the interior of the can simultaneously with the can holding device. In order to achieve a flow in the can, which improves the lacquer quality, the internal electrode can be of hollow construction. Filtered lacquer is pumped through this feed pipe into the can. By installing jets in the electrophoresis basin, which are directed against the arched base of the can, gas bubbles can additionally be removed from the bottom wall by directed lacquer currents. The can is turned in order to empty it, the bottom of the can being brought to the top. On leaving the bath, the suspension gear, together with the cans, is first rinsed with ultrafiltrate and then with water, to which solvents and/or emulsifiers can be added, if necessary, to avoid wetting failures. Subsequently, the lacquer is stoved for times from 1 to 300 seconds at temperatures of 180° to 250° C., preferably for 120 to 180 seconds at 210° to 230° C. In so doing, the transporting belt, together with the suspension gear and the can, is passed as a unit through the kiln. In a preferred embodiment, the bottom of the can may be predried and provided with a protective auxiliary coating. Transfer to a conveyor belt, which passes through the drying kiln, can then be effected. The opening of the can may be directed downwards or preferably upwards.

In a different process, a stepwise procedure is followed, that is, the outside wall of the can is lacquered conventionally at first and then—after an intermediate drying step—the rest of the can (bottom and inside) is coated electrophoretically, the counterelectrode being introduced into the can. This "reserve process" has the advantage that the lacquer system, required for each operating cycle, can be optimized to its special properties.

A special case of this process is one in which the unlacquered cans are printed with one or several printing inks, which essentially are not electrically conducting, and then coated by the EC coating process, in which those parts of the can, on which there is no printing, are coated with the EC lacquer. An improved manufacturing process becomes possible when this variation is used. The bare can, which has not been flanged, can be printed as previously in conventional printing machines of the state of the art. The printed can is then flanged and subjected inventively to the overall EC coating process. Sections of the can of any size can be printed with a conventional printing ink. For example, it is possible to print 5 to 95% of the exterior surface of the can pictorially with at least one printing ink (several different printing inks can also be printed consecutively) by the offset printing process. After drying, a print is produced, which is stable in the EC bath and has a sufficient specific film resistance, for example, one of more than $10^7$ ohms×cm over the whole region of the printed image, so that no EC lacquer is deposited here, and the printed image is coated with an EC lacquer, which is transparent or has a different color. The specific film resistance should of course be so high, that EC lacquer deposition is avoided. Preferably, it is therefore higher than $10^8$ ohms×cm and especially higher than $10^{10}$ ohms×cm over the whole region of the printed image. Care must be taken that the printing inks do not contain components, especially not pigments, which would produce a significant electrical conductivity. Printing is carried out by known procedures, for example by the wet offset, the dry offset or the screen printing procedure. There is an unexpectedly sharp boundary between the printed regions and the regions coated in the EC bath. Films of different thickness can be achieved with the printing ink on the one hand the EC bath coating on the other, if this is desired.

During continuous coating processes, amine accumulates in the EC basin when anionic binders are used and carboxylic acid when cationic binders are used. In order to compensate for this effect, either the replenishing material is neutralized correspondingly less or excess neutralizing agent is removed by electrodialysis. The rinsing water is concentrated by ultrafiltration and returned once again to the lacquer basin, as a result of which the utilization of the lacquer is increased and the interfering extraneous ions are removed.

Two examples of an installation for carrying out the inventive process are shown schematically in the drawings.

FIG. *2a* shows transfer of the cans from the outside to the inside of the magnetic wheel.

DETAILED DESCRIPTION OF THE DRAWINGS

Figure 1:
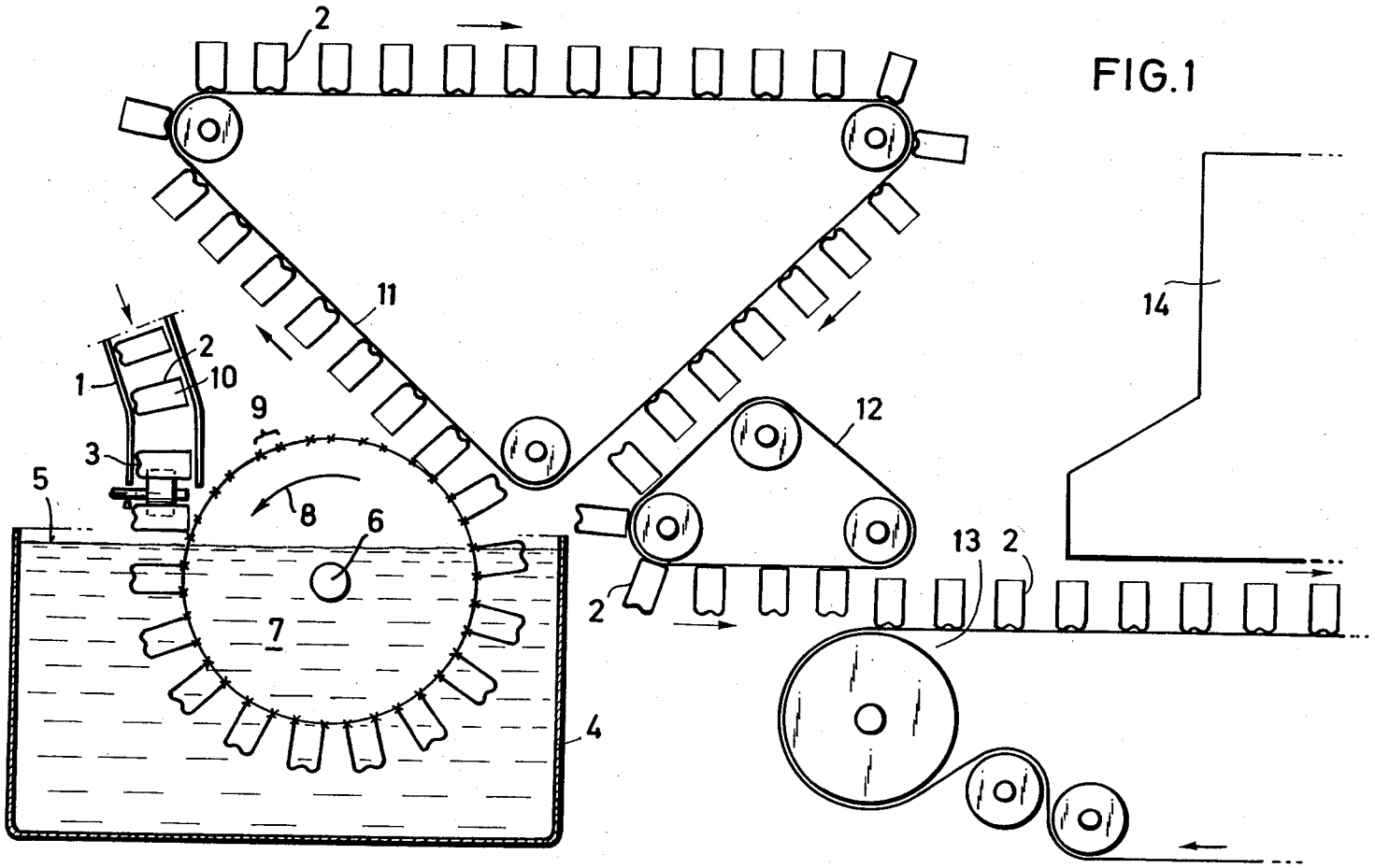
FIG. 1 shows an installation, in which the cans, which are to be coated electrophoretically, are held by their open ends as they are passed through the immersion

In the installation of FIG. 1, cans 2, which are open at one end, are fed by a fall shaft 1 in such a way, that their inwardly arched bottom 3 lies on the outside. Fall shaft 1 ends above bath container 4, which is filled to a level 5 with an electrophoretic lacquering liquid. Fall shaft 1 ends above the liquid level 5. A star-shaped wheel 7, details of which are not shown in FIG. 1 and which can be rotated about a horizontal axis 6 in the direction of arrow 8, is mounted above bath container 4. On the outer circumference of this star-shaped wheel, there are mechanical holders 9, which take hold of each can mechanically and, in so doing, at the same time form the required electrical contacts. The counterelectrode is arranged on the bath container 4 at some distance from the star-shaped wheel 7 and below the liquid level 5.

Although only one star-shaped wheel 7 is indicated in FIG. 1, actually several star-shaped wheels of this type are arranged next to each other and can be rotated together about axis 6. For example, a total of 16 star-shaped wheels 7 next to each other is provided, so that 16 cans 2 can simultaneously be passed next to each other through immersion bath 4. The star-shaped wheels 7 are sufficiently far apart, so that neighboring cans 2 do not touch each other.

As shown in FIG. 1, cans 2 are passed by star-shaped wheel 7 on a circular path through immersion bath 4, meeting liquid level 5 with their openings pointing slightly downwards and dipping in this position into the bath. In so doing, the interior of the individual cans is rapidly flooded. The cans, dipped in the bath, travel through the same in such a way, that their longitudinal axis constantly becomes more vertical, so that the air in the interior of the cans can escape from the opening, which is constantly pointing more towards the top, and the cans are filled correspondingly rapidly with liquid. As they pass through the immersion bath, the immersed cans are coated electrophoretically in the above-described manner with the lacquer filling the immersion bath.

At the end of their passage through the immersion bath, the cans are lifted from the bath with their openings once again inclined slightly downwards and are then tilted further, so that the bath liquid in the cans is certain to run out.

Above star-shaped wheels 7, there is an endless magnetic belt 11, to which the coated cans 2, released by the holding devices 9, are transferred with their bottom 3 lying on the belt. This magnetic belt 11 functions as a transfer section, in which predrying of the wet film, applied on the cans, can take place. It is also possible to carry out rinsing process on the coated cans 2 in the region of the magnetic belt.

From magnetic belt 11, the cans 2 are transferred to a further magnetic belt 12, on which the cans 2 are held by their open end. This magnetic belt 12 transfers the cans to a transporting belt 13 of a drying kiln 14, on which the cans 2, in the example of the operation shown, are placed with their bottom pointing downwards and at a distance from each other.

After having passed through the drying kiln 14, the electrophoretically applied coating on cans 2 is dry, so that the cans now, should this be desired, can also be labelled or printed.

If for any reason cans 2 are to be passed through drying kiln 14 with their opening 14 pointing downwards, magnetic belt 11 can transfer cans 2 directly to the transporting belt 13 of drying kiln 14. In order to be certain of avoiding surface defects in the coating, it is essential that cans 2, passed consecutively and next to each other through the installation, are always moved at a sufficient distance from each other, so that they cannot touch one another.

The installation, shown in FIG. 1, can be used in conjunction with already existing drying kilns 14, that is, drying kiln 14 and its transporting belt 13 need not be rebuilt or modified for use with preceding sections of the installation. The installation, shown in the drawing, can therefore be operated with already existing sections of the installation.

Figures 2, 2A:
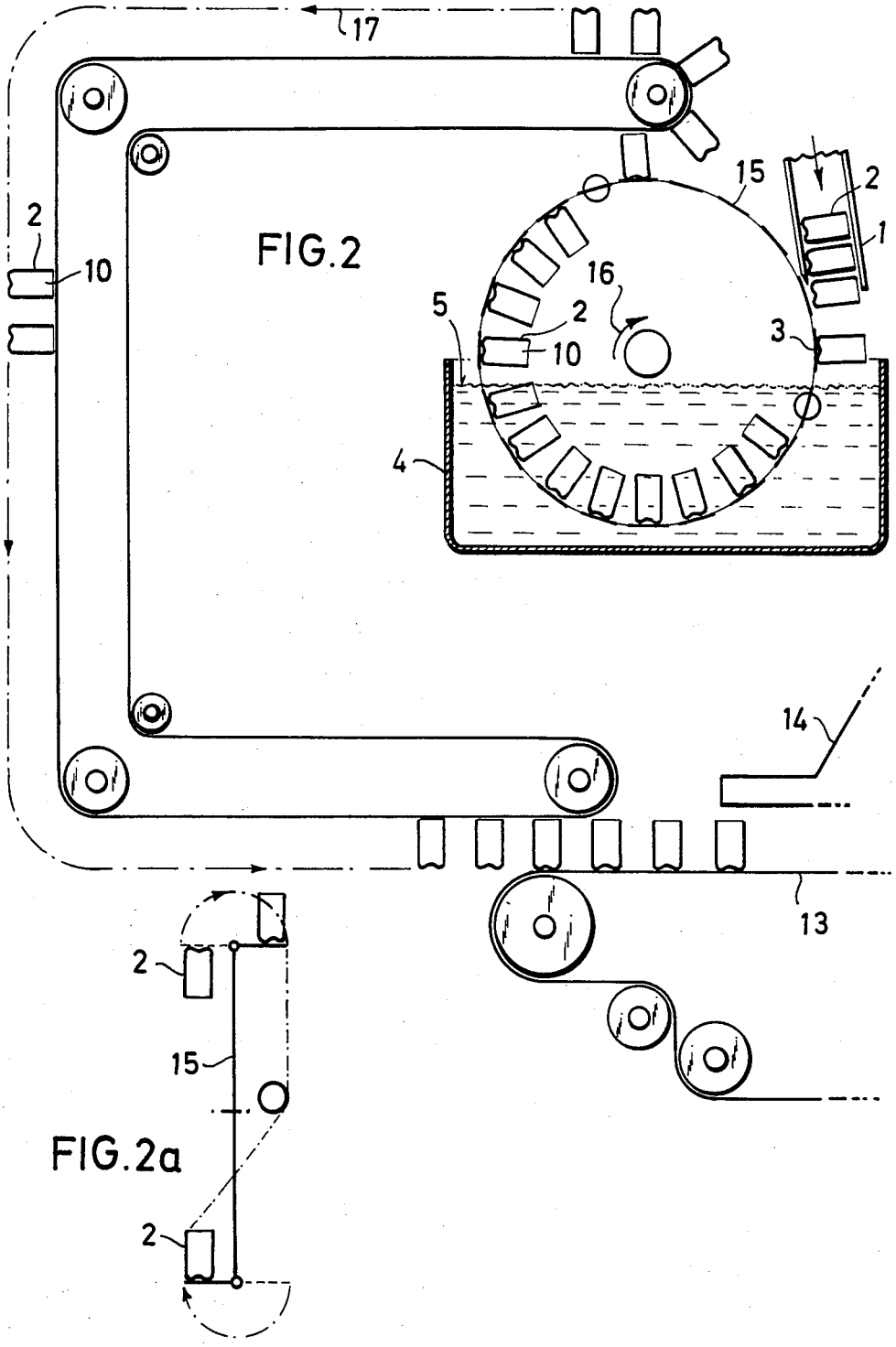
FIG. 2 shows an installation, in which the cans, which are to be coated electrophoretically, are held by their closed ends as they are passed through the immersion bath and conveyed by means of a single conveyor element to the transporting belt, which passes through a drying kiln.

The installation, shown in FIG. 2, differs from that shown in FIG. 1 essentially in that cans 2, which are to be coated, are held by their bottom as they are transported through the immersion bath 4 and that only a single conveying element, on which cans 2 are held by their open end, is required for transfer to transporting belt 13 of drying kiln 14.

Cans 2 are supplied from a falling shaft 1 and, above the liquid level 5 of immersion bath 4, are transferred to a magnetic wheel 15, to which they are transferred with their bottom 3, which has a sufficiently large mass, suitable for this purpose. In the area of liquid level 5, the cans 2 are transferred from the outside to the inside of magnetic wheel 15, as indicated in FIG. *2a*. Magnetic wheel 15 is turned in the direction of arrow 16, so that cans 2 pass through immersion bath 4 in much the same way as in the example of the operation shown in FIG. 1 and, in so doing, are flooded with bath fluid, then coated electrophoretically and finally, after being lifted out of the immersion bath, emptied of bath fluid.

Close to the highest point of magnetic wheel 15, the cans 2 are returned to the outside of the wheel and transferred to a magnetic conveyor 17, to whose endless transporting element they adhere with their open end 10.

Magnetic conveyor 17, which may also be a different transporting element, such as, for example, an endless chain conveyor on which the cans are then held mechanically, conveys cans 2 to transporting belt 13 of drying kiln 14, on which it deposits the cans with their bottom downwards, so that the cans are passed at a distance from each other through drying kiln 14.

In this embodiment also, several cans 2 can simultaneously be passed next to each other through immersion bath 4, for example, 16 cans. It is important once again that the cans are sufficiently far apart already in immersion bath 4, so that neither consecutive cans, nor cans arranged next to each other, touch one another, which could lead to surface defects.

EXAMPLE 1

The anionic, self cross linking acrylate resin of DE-B-16 69 107 was partially neutralized with ammonia and diluted with deionized water to a solids content of 15 weight percent. A flanged can (with a diameter of 65 mm and a length of 116 mm) was held at the flange by an electrically conducting clamp and completely immersed carefully into a conducting vessel having a diameter of 19 cm, which was filled diluted lacquer and insulated against ground. The can was connected to the anode and the exterior vessel and auxiliary electrode were connected as cathode to a source of direct current. The auxiliary electrode in the interior of the can had a depth of immersion of 8 cm and an electrode diameter of 2 cm. After being rinsed with water the can was stoved for 3 minutes at 215° C. in a forced-air oven. The can was completely coated on the inside and outside with a thin, clear lacquer, which was nonporous.

The measured values are given in Table 1.

EXAMPLE 2

The binder of example 1 was pigmented with 0.4 parts by weight of titanium dioxide to 1 part by weight of binder and, after neutralization with ammonia, diluted to a solids content of 9 weight percent. Coating was carried out without the use of an auxiliary electrode. The can was coated completely with a white lacquer. The porosity, measured in an electrolyte solution at 4 volts, amounts to 5 mA after 30 seconds.

The measured values are given in Table 1.

EXAMPLE 3

A cationic aminoepoxide resin of DE-B-31 22 641 was pigmented with 0.4 parts by weight of a mixture of 99 parts by weight of titanium dioxide and 1 part by weight of carbon black and, after neutralization with formic acid, diluted to a solids content of 15 weight percent with deionized water. Coating was carried out without an auxiliary electrode. The can was coated completely with a gray lacquer.

The measured values are given in Table 1.

EXAMPLE 4

A deep-drawn metal can is washed, dried and printed pictorially in a panoramic printing machine by the dry offset process with a red printing ink of conventional composition, which essentially is nonconducting electrically, with a decoration under the usual printing prestress, a nonporous, uniform, colored film being produced. After drying, the printed image has a specific film resistance of about $2\times10^8$ ohms×cm. The can, so printed, is dried in the usual manner for 70 seconds at 180° C. in a continuous oven, then drawn in, flanged and coated, as described in Example 1, with a white, pigmented EC lacquer, which contains a carboxyl-group-containing, self-cross linking, polyacrylate mixture as binder. The total solids content of the bath is 15 weight percent, the pigment binder ration 0.5:1, the MEQ value 49 and the pH 8.8. The pH is adjusted with ammonia. The bath conductivity is 1,700 μmhos/cm. The can is connected as anode and the EC basin, insulated against ground, as cathode. Deposition voltage: 110 volts. Deposition time: 15 seconds. After it is coated, the can is rinsed with completely desalinated water and dried for 90 seconds at 210° C. on a wire grating with the opening at the top in a drying kiln. The deposition conditions, especially voltage and time, were selected so that a good throwing power was achieved, when an electrode projecting into the can was used. The outside of the can, on those areas of metal on which there was no printing, as well as the inside of the can were coated with the EC lacquer. The white lacquer film thickness achieved was about 10 to 12 μm.

A clean coating, demarcated from but not overlapping the image, is obtained in the EC bath. Instead of the deep-drawn can with bottom, which is used in the example, it is also possible to use soldered or welded cans, the soldered or welded seam or places being coated perfectly in the EC bath.

The pictorial decorations can be printed over the whole surface by halftone or line processes.

EXAMPLE 5

The procedure of Example 4 is followed. However, the EC basin is connected as cathode in the EC coating process and no auxiliary electrode is used.

EXAMPLE 6

The procedure is essentially the same as in Examples 4 and 5. The can is printed with four colors in a conventional 4-color printing machine. The EC coating process is carried out on areas, on which there is no printing, with a clear lacquer, which contains an externally cross-linked acrylatemelamine resin system as binder. Deposition conditions, 150 volt, 15 seconds, 25° C. Film thicknesses of the EC coating after stoving: 7 to 8 μm. The coating process is carried out only with an internal electrode in an insulated EC basin.

Preferably the term "slightly" in connection with defining how the openings of the hollow bodies are pointing or declined downwards shall mean an angle of greater than 1°, more preferably greater than 3° and less than 20°, more preferably less than 15°.

TABLE 1

| | Example | | |
|---|---|---|---|
| | 1 | 2 | 3 |
| Solids Content | 14.9 Weight percent | 8.7 Weight percent | 14.8 Weight percent |
| pH-Value | 8.3 | 8.6 | 5.5 |
| Bath Conductivity | 1977 $\mu mhocm^{-1}$ | 940 $\mu mhocm^{-1}$ | 1640 $\mu mhocm^{-1}$ |
| MEQ Value | 54 | 40 | 45 |
| Bath temperature | 25° C. | 25° C. | 25° C. |

TABLE 1-continued

| | Example | | |
|---|---|---|---|
| | 1 | 2 | 3 |
| Deposition time | 16 s | 16 s | 4 s |
| Voltage | 100 Volt | 100 Volt | 240 Volt |
| Amount of current | 39 Amp,s | 31 Amp,s | 25 Amp,s |
| Lacquer applied per can | 792 mg | 895 mg | 663 mg |
| Film resistance | $1.3 \cdot 10^8$ Ohm · cm | $1.3 \cdot 10^8$ Ohm · cm | $3.9 \cdot 10^8$ Ohm · cm |

We claim:

1. Process for coating electrophoretically the insides and outsides of hollow bodies, open at one end, with lacquer comprising submerging each hollow body by dipping it with its opening pointing slightly downwards in a continuous operating cycle into an electrophoretic immersion bath, and while submerged in the bath coating electrophoretically the inside and outside of said hollow body by passing an electrical current through the electrophoretic immersion bath, and also while submerged in the bath moving said hollow body in such a way that its opening points upward, and subsequently, with its opening pointing slightly downwards, lifting said hollow body out of the bath, and then passing said hollow body through one or several drying kilns with an endless means of transportation.

2. Process as defined in claim 1, wherein the hollow bodies are passed in a partial circle through the immersion bath.

3. Process as defined in claim 1, wherein the hollow bodies are passed on a two-dimensional sinusoidal path through the immersion bath.

4. Process of claim 1, wherein the hollow bodies are passed through the electrophoretic immersion bath for a period of 1 to 120 seconds and, in so doing, are coated with a wet film, which is deposited on their surfaces and has an electrical film resistance of at least $0.6 \times 10^8$ ohms×cm.

5. Process as defined in claim 1, wherein the hollow bodies are held during the coating process by their open ends on a transporting element, which guides them through the immersion bath.

6. Process according to claim 1, wherein said hollow bodies open at one end are cans provided with a bottom.

7. Process as defined in claim 6, wherein the hollow bodies are passed through the electrophoretic immersion bath for a period of 1 to 120 seconds and, in so doing, are coated with a wet film, which is deposited on their surfaces and has an electrical film resistance of at least $0.6 \times 10^8$ ohms×cm.

8. Process as defined in claim 6, wherein several hollow bodies are lacquered and dried simultaneously next to each other and at a mutual distance from one another.

9. Process as defined in claim 6, wherein the hollow bodies are held during the coating process by their open ends on a transporting element, which guides them through the immersion bath.

10. Process as defined in claim 6, wherein the hollow bodies are first of all flanged at their open end, then washed, subsequently coated and finally dried and optionally labelled or printed.

11. Process as defined in claim 10, wherein the hollow bodies, after they are coated and before they are dried, are rinsed with ultrafiltrate or water.

12. Process as defined in claim 6, wherein the hollow bodies, after being lifted out of the bath, are placed at a mutual distance from one another on an endless means of transportation, such as a conveyor belt, which guides them through one or several drying kilns.

13. Process as defined in claim 6, wherein the hollow bodies are washed, the sides of the cans are then coated conventionally on the outside and dried and subsequently the bottom and inside of the cans are coated in the electrophoretic immersion bath.

14. Process as defined in claim 13, wherein the hollow bodies are conventionally coated pictorially in sections of their sides and then coated in the electrophoretic immersion bath.

15. Process as defined in claim 14, wherein 5 to 95% of the sides of the hollow body is printed pictorially with at least one printing ink by the offset or printing screen process and dried so as to produce a print which, after drying, is stable in the electrophoretic immersion bath and has a specific film resistance of more than $10^7$ ohms×cm in the total region of the printed image and is then coated with a transparent coating or in a different color in the electrophoretic immersion bath.

16. Process of claim 7, wherein the electrical film resistance is at least $1 \times 10^8$ ohms×cm.

17. Process of claim 6, wherein the hollow bodies are passed in a partial circle through the immersion bath.

18. Process of claim 6, wherein the hollow bodies are passed in a two-dimensional sinusoidal path through the immersion bath.

19. Process as defined in claim 7, further comprising holding the individual cans on the transporting element by a holding device which is wired electrically as one electrode for the electrophoretic lacquer coating process, while the counter-electrode is in the immersion bath at a distance from the transporting path of the hollow bodies.

20. Process as defined in claim 6, further comprising holding the individual cans on the transporting element by a holding device which is wired electrically as one electrode for the electrophoretic lacquer coating process, while the wall of the basin is wired on the counter-electrode.

21. Process as defined in claim 6, further comprising holding the individual cans on the transporting element by a holding device which is wired electrically as one electrode for the electrophoretic lacquer coating process, while counterelectrodes are used which can be inserted into the individual hollow bodies and whose distance from the inner wall of the hollow bodies is greater than half the radius of the hollow bodies.

* * * * *